US006799427B2

(12) United States Patent
Calvez et al.

(10) Patent No.: US 6,799,427 B2
(45) Date of Patent: Oct. 5, 2004

(54) MULTIMODE SYSTEM FOR INJECTING AN AIR/FUEL MIXTURE INTO A COMBUSTION CHAMBER

(75) Inventors: Gwénaëlle Calvez, Melun (FR); Didier Feder, Nandy (FR); Marion Michau, Vincennes (FR); Frédéric Ravet, Ivry (FR); José Rodrigues, Nandy (FR); Alain Schuler, Fontenay-Sous-Bois (FR); Alain Tiepel, Chailly-En-Biere (FR); Christophe Viguier, Alfortville (FR)

(73) Assignee: SNECMA Moteurs, Paris (FR)

( * ) Notice: Subject to any disclaimer, the term of this patent is extended or adjusted under 35 U.S.C. 154(b) by 4 days.

(21) Appl. No.: 10/379,917

(22) Filed: Mar. 6, 2003

(65) Prior Publication Data

US 2004/0025508 A1 Feb. 12, 2004

(30) Foreign Application Priority Data

Mar. 7, 2002 (FR) ..... 02 02875

(51) Int. Cl.[7] ..... F02C 7/22; F02C 3/30
(52) U.S. Cl. ..... 60/737; 60/748
(58) Field of Search ..... 60/737, 738, 740, 60/746, 748

(56) References Cited

U.S. PATENT DOCUMENTS 4,974,416 A * 12/1990 Taylor ..... 60/737
5,623,827 A * 4/1997 Monty ..... 60/748
5,816,049 A 10/1998 Joshi
5,941,075 A * 8/1999 Ansart et al. ..... 60/748
6,256,995 B1 7/2001 Sampath et al.
6,345,505 B1 2/2002 Green

* cited by examiner

*Primary Examiner*—Louis J. Casaregola
(74) *Attorney, Agent, or Firm*—Oblon, Spivak, McClellan, Maier & Neustadt, P.C.

(57) ABSTRACT

The invention provides an injection system for injecting an air/fuel mixture into a combustion chamber of a gas turbine engine, the injection system having a longitudinal axis and comprising fuel injection means, interposed between first and second air injection means, the fuel injection means being disposed in an annular internal cavity of a Venturi, the fuel injection means comprising at least a first fuel admission circuit provided with at least one fuel injection orifice, and a plurality of second fuel admission circuits independent from the first fuel admission circuit(s), each being provided with at least one fuel injection orifice so as to define a plurality of independent modes of injecting the air/fuel mixture depending on determined operating speeds of the engine, the fuel injection orifice of the first fuel admission circuit being formed in the upstream wall of the Venturi so as to inject fuel towards the combustion chamber in a general direction that is substantially perpendicular to a flow of air coming from the first air injection means, and the fuel injection orifices of the second fuel admission circuits being formed in the downstream wall of the Venturi so as to inject fuel towards the combustion chamber in a general direction that is substantially perpendicular to a flow of air coming from the second air injection means.

11 Claims, 4 Drawing Sheets

MULTIMODE SYSTEM FOR INJECTING AN AIR/FUEL MIXTURE INTO A COMBUSTION CHAMBER

BACKGROUND OF THE INVENTION

The present invention relates to the general field of systems for injecting fuel into a combustion chamber of a gas turbine engine. More particularly, the invention relates to a system for injecting an air/fuel mixture, which system provides multimode fuel injection enabling at least two independent modes to be defined for injecting the air/fuel mixture, depending on predetermined operating speeds of the engine.

In each injection system of a conventional combustion chamber of a gas turbine engine, fuel is injected in single mode manner via a fuel injector. Two air swirlers centered on the fuel injector deliver respective radial flows of air downstream from the point of fuel injection so as to mix the air and fuel that are to be injected into the combustion chamber and then burnt. The flows of air coming from the two swirlers are generally defined by a Venturi interposed between said swirlers, and a bowl mounted downstream therefrom accelerates the flow of the air/fuel mixture towards the combustion chamber.

The air/fuel mixture obtained by such injection systems needs to be optimized in order to light combustion in the combustion chamber, in order to ensure that combustion is stable, in particular at low operating speeds of the engine, and in order to limit the emission of pollution into the atmosphere, in particular when the engine is operating at full throttle. These requirements imply modes of operation that are often mutually incompatible. For example, stability of the combustion flame, which is necessary in particular at low operating speeds of the engine, is encouraged by having an air/fuel mixture that is non-uniform, presenting rich zones in the air/fuel mixture close to lean zones. Conversely, the formation of pollutants such as nitrogen oxides is limited by making combustion take place in a mixture that is lean and uniform.

A single-mode fuel injection system as described above cannot satisfy all of the above-specified operating requirements correctly. Fuel injection in such systems takes place in zones where the mass of air injected is lower, thereby tending to make the air/fuel mixture non-uniform. Furthermore, fuel injection reduced to a single point is optimized for only one or at most two operating speeds of the engine. In particular, when operating at idling speed, such injection systems do not operate properly, which leads to high levels of carbon monoxide emissions.

In order to mitigate those drawbacks, it is known to use combustion chambers having two heads, where the idea is to separate low and high speed combustion by providing the chamber with fuel injectors distributed on a "pilot" head and on a "takeoff" head spaced apart from the pilot head both radially and axially. Although that solution would appear to be satisfactory, a combustion chamber having two heads remains difficult to control and expensive, given the duplication of the number of fuel injectors compared with a conventional single-head combustion chamber.

U.S. Pat. No. 5,816,049 also discloses a system for injecting an air/fuel mixture in which fuel injection takes place in multiple manner via orifices provided in a Venturi defining flows of air coming from a radial swirler and from an axial swirler via orifices that open out into the passage for the flow of air coming from the radial swirler. However, the injection system described in that patent also presents drawbacks. The injection orifices are fed with fuel, in particular via a plurality of feed ducts, thereby considerably increasing the risk of fuel coking. In addition, the particular disposition of the fuel injection orifices relative to the air injection leads to significant risks of fuel penetrating into the air injection circuit.

OBJECT AND SUMMARY OF THE INVENTION

The present invention thus seeks to mitigate such drawbacks by proposing an injection system comprising a multimode system for injecting an air/fuel mixture which enables an air/fuel mixture to be prepared that is optimized both for low speed conditions and for high speed conditions in order to limit polluting emissions. The invention also seeks to provide an injection system that limits the risks of coking and prevents any ingress of fuel into the air feed system.

To this end, the invention provides an injection system for injecting an air/fuel mixture into a combustion chamber of a gas turbine engine, said injection system having a longitudinal axis and comprising fuel injection means interposed between first and second air injection means, said fuel injection means being disposed in an annular internal cavity of a Venturi, said cavity being defined by a substantially axial upstream wall and by a substantially radial downstream wall, said fuel injection means comprising at least a first fuel admission circuit provided with at least one fuel injection orifice, and a plurality of second fuel admission circuits independent from the first fuel admission circuit(s), each being provided with at least one fuel injection orifice so as to define a plurality of independent modes of injecting the air/fuel mixture depending on determined operating speeds of the engine, wherein the fuel injection orifice of the first fuel admission circuit is formed in the upstream wall of the Venturi so as to inject fuel towards the combustion chamber in a general direction that is substantially perpendicular to a flow of air coming from the first air injection means, and wherein the fuel injection orifices of the second fuel admission circuits are formed in the downstream wall of the Venturi so as to inject fuel towards the combustion chamber in a general direction that is substantially perpendicular to a flow of air coming from the second air injection means.

As a result, the injection system makes it possible both to generate an air/fuel mixture that is uniform and lean under high speed conditions in order to limit polluting emissions of nitrogen oxide, and also to create pockets of gas in stoichiometric proportion under low speed conditions in order to guarantee lighting and combustion flame stability in the chamber while still keeping emissions of carbon monoxide down. The air/fuel mixture is injected in multiple modes depending on the operating conditions of engine. The distribution of fuel in the injection system can thus be under complete control as a function of the mass of air introduced by the air injection means. In addition, injecting fuel in directions that are perpendicular to the flows of air coming from the air injection means improves homogenization of the air/fuel mixture.

Advantageously, the fuel injection orifices of the first and second fuel admission circuits are regularly distributed around the longitudinal axis and occupy angular positions that are mutually offset so as to improve homogenization of the mixture.

A single feed duct can feed fuel to the first and second fuel admission circuits, e.g. via a plurality of concentric tubes. Thus, fuel feed takes place via a single duct, thereby limiting the risks of coking and taking advantage of the cooling that is obtained by fuel flowing in the circuits.

Additional air or fuel injection means centered on the longitudinal axis of the injection system advantageously serve to define additional modes of air/fuel mixture injection. Such means are mounted on a bowl centered on the longitudinal axis and extending downstream from the first air injection means.

BRIEF DESCRIPTION OF THE DRAWINGS

Other characteristics and advantages of the present invention appear from the following description given with reference to the accompanying drawings which show an embodiment that has no limiting character. In the figures.

DETAILED DESCRIPTION OF AN EMBODIMENT

Figure 1:
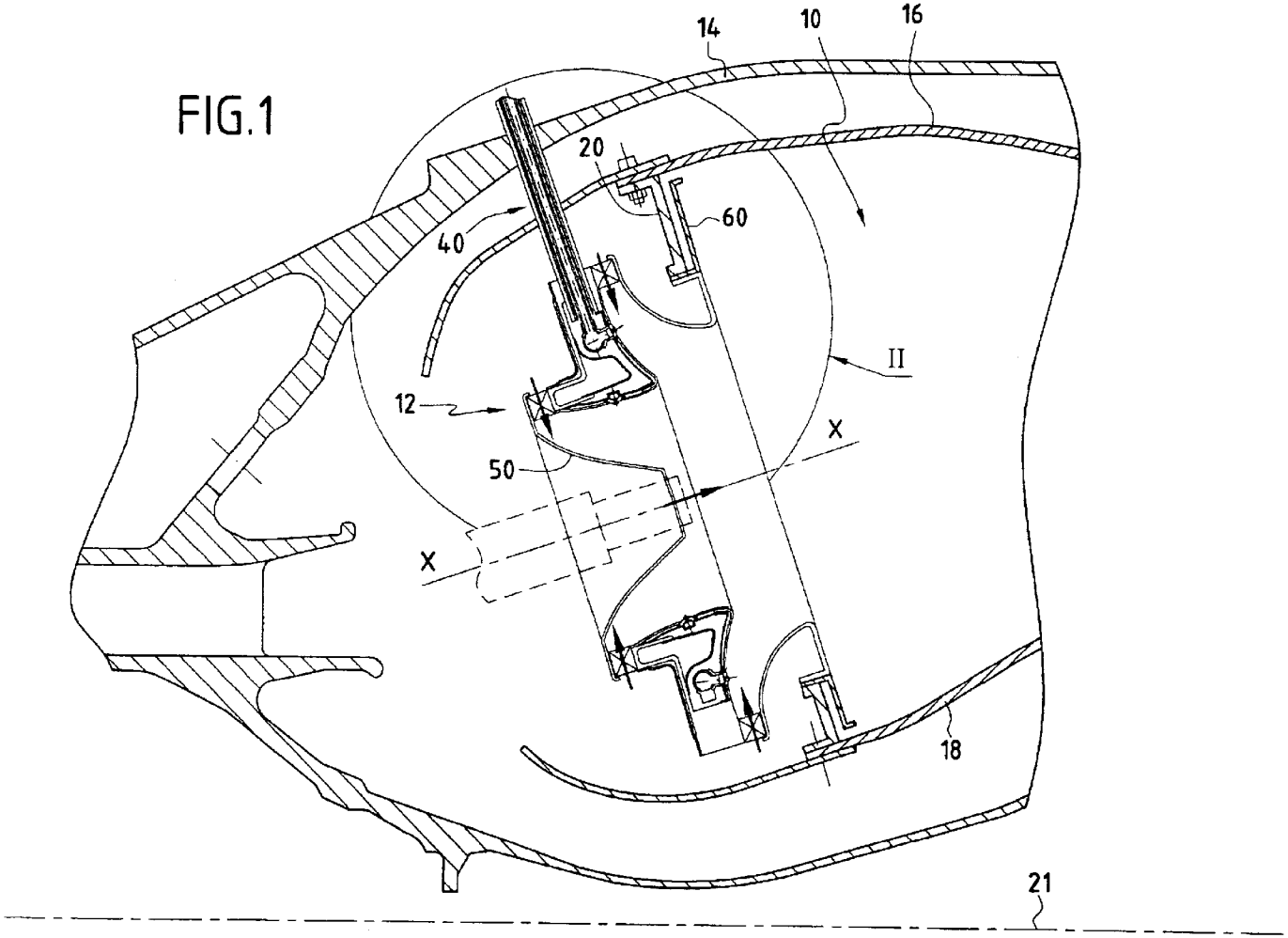
FIG. 1 is a fragmentary section view of a combustion chamber fitted with injection systems constituting an embodiment of the invention.

Reference is made to FIG. 1 which shows a portion of a combustion chamber 10 in section, the chamber being fitted with a plurality of systems 12 for injecting an air/fuel mixture. The combustion chamber 10 is secured to an outer casing 14 by fixing means that are not shown. By way of example, it is of the annular type and it is defined by two annular walls 16 and 18 connected together at an upstream end by an annular end wall 20 for the chamber. The chamber end wall 20 has a plurality of openings that are regularly spaced apart in circular manner about an axis 21 of the gas turbine engine that is fitted with such a combustion chamber. An injection system 12 of the invention is mounted in each of these openings. The injection systems prepare a mixture of air and fuel that is to be burnt in the combustion chamber 10. The gas coming from said combustion flows downstream from the chamber prior to being fed to a high pressure turbine.

Figure 2:
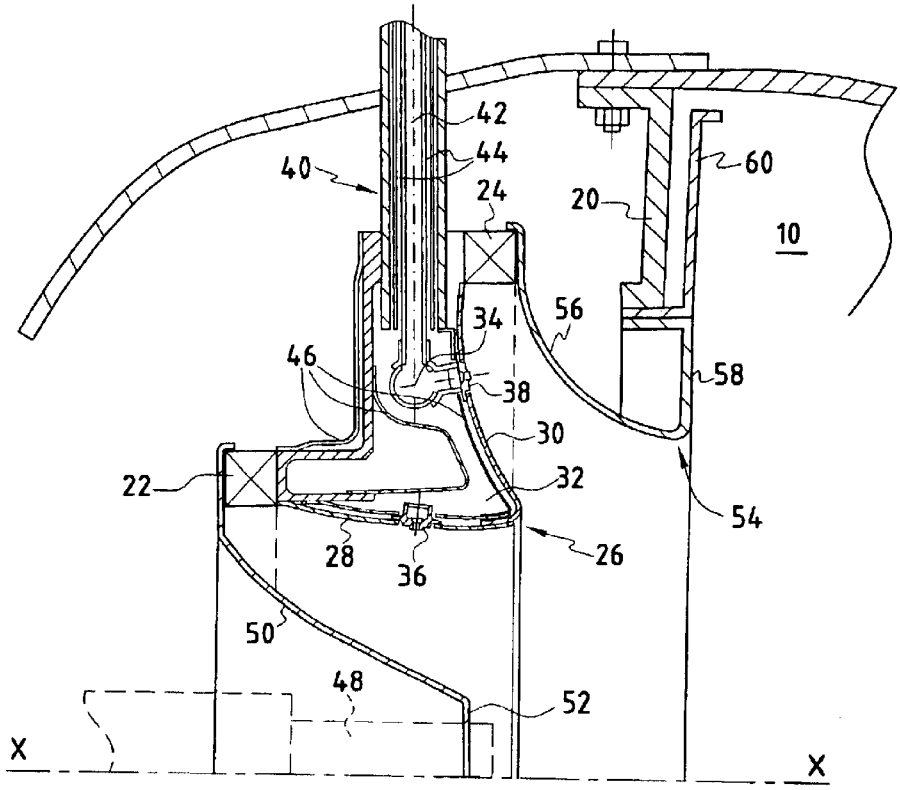
FIG. 2 is a fragmentary view on a larger scale of a FIG. 1 injection system.

As shown more particularly in FIG. 2, the injection system 12 of longitudinal axis X—X comprises fuel injection means interposed between first and second air injection means. The first and second air injection means are preferably constituted respectively by inner and outer swirlers 22 and 24 disposed radially relative to the longitudinal axis X—X. These air swirlers are of conventional type and each of them thus delivers a flow of air in a direction that is substantially radial. The outer swirler 24 is mounted so as to be offset radially relative to the inner swirler 22.

The fuel injection means are mounted in an annular inner cavity of an annular Venturi 26 centered on the longitudinal axis X—X of the injection system and defining the boundaries of the flows of air from the inner and outer swirlers 22 and 24. The Venturi comprises in particular an upstream wall 28 extending in a substantially axial direction from the inner swirler 22 and itself extended by a downstream wall 30 that is substantially radial and that is connected to the outer swirler 24.

The fuel injection means comprise at least one first fuel admission circuit 32 and a plurality of second fuel admission circuits 34. The first and second circuits are mutually independent, and in particular they are defined by the upstream and downstream walls 28 and 30 of the Venturi 26. For reasons of clarity in the drawings, the fuel injection means shown in FIGS. 1 to 3 comprises a single first fuel admission system and a single second fuel admission circuit. Naturally, it is possible to envisage that these injection means comprise a plurality of first and second circuits.

The first fuel admission circuit 32 opens towards the combustion chamber 10 in a general direction that is substantially radial via at least one fuel injection orifice 36 formed in the upstream wall of the Venturi. The second fuel admission circuits 34 open towards the combustion chamber 10 in a substantially axial general direction via at least one fuel injection orifice 38 formed in the downstream wall of the Venturi. Thus, in accordance with the invention, the fuel present in the first fuel admission circuit 32 is injected into the air flow generated by the inner swirler 22 in a general direction that is substantially perpendicular to said flow. Similarly, the fuel present in the second fuel admission circuits 34 is injected into the air flow generated by the outer swirler 24 in a general direction that is substantially perpendicular to said flow. By way of example, six fuel injection orifices may be provided per fuel admission circuit.

According to an advantageous characteristic of the invention, the fuel injection orifices 36, 38 of the first and second fuel admission circuits 32, 34 are distributed regularly all around the longitudinal axis X—X of the injection system, and the orifices 36 of the first circuit occupy angular positions that are offset relative to the orifices 38 of the second circuits. This characteristic makes it possible to improve the uniformity of the air/fuel mixture. In addition, the fuel injection orifices are preferably not disposed facing air outlets from the inner and outer swirlers.

Figure 3:
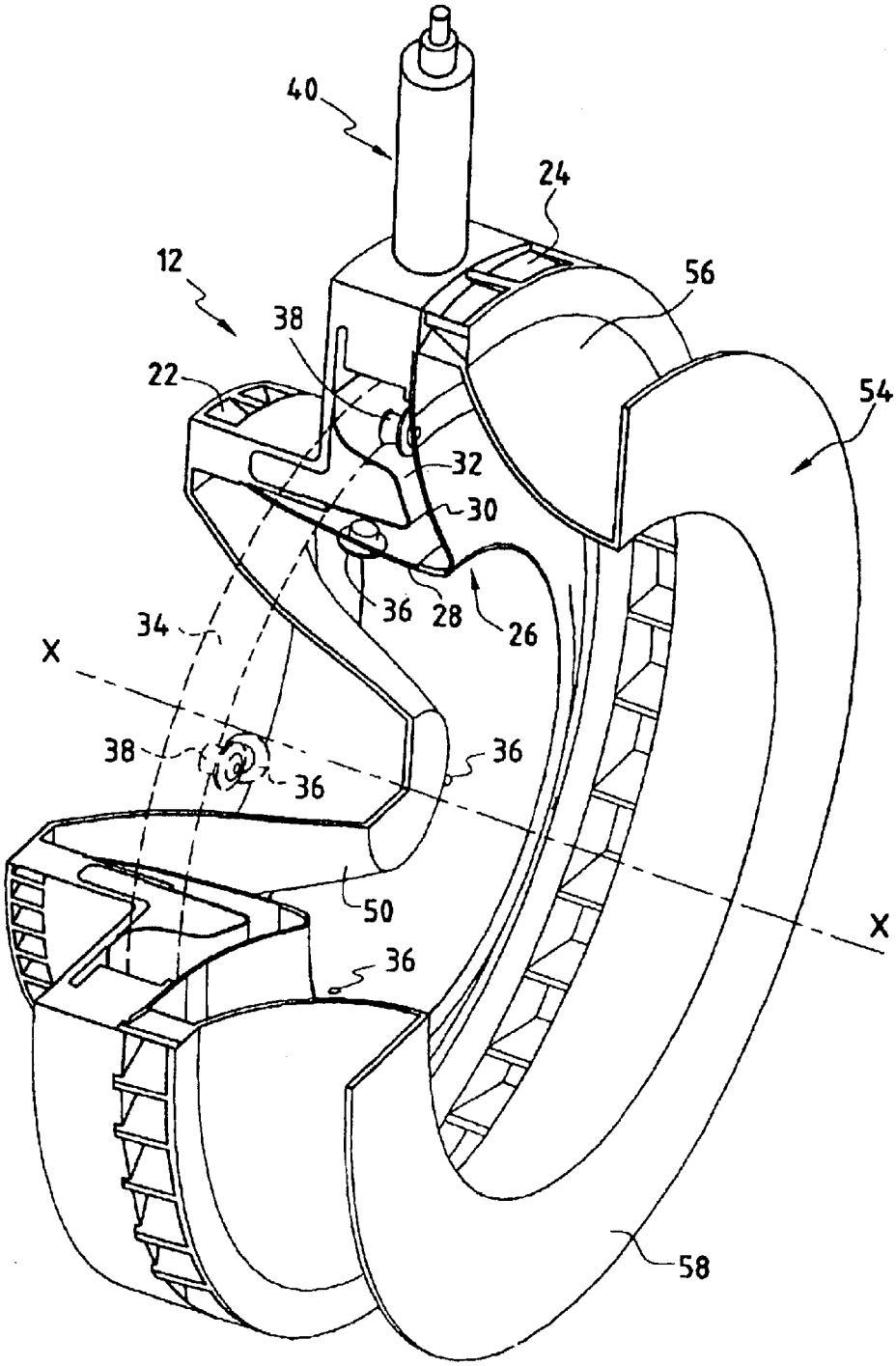
FIG. 3 is a cutaway perspective view of a FIG. 1 injection system.

The presence of at least one first and a plurality of second independent fuel and admission circuits each provided with at least one fuel injection orifice enables a plurality of independent modes of injecting an air/fuel mixture to be defined depending on particular operating speeds of the engine. For example, when the fuel injection means comprise a single first and a single second fuel admission circuit as shown in FIGS. 1 to 3, fuel injection via the first circuit 32 can correspond to the engine operating at idling speed, while fuel injection via the first and second circuits can be appropriate for the engine operating at full throttle.

Figure 4:
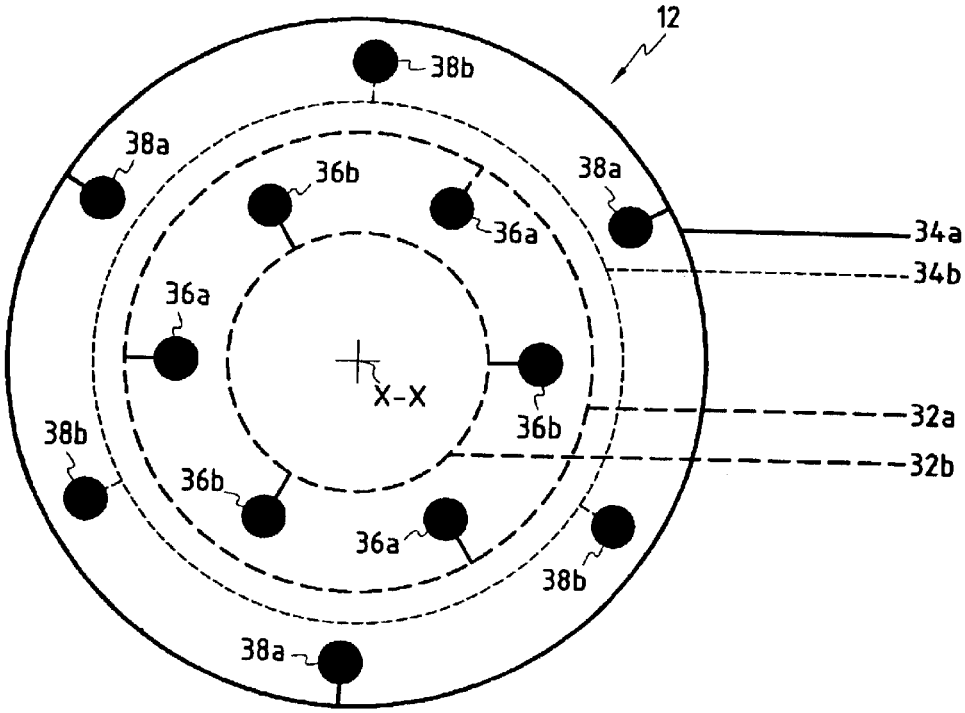
FIG. 4 is a diagrammatic front view of an injection system constituting a different embodiment of the invention.

In another embodiment of the invention as shown diagrammatically in FIG. 4, two first fuel admission circuits 32*a* & 32*b* and two second fuel admission circuits 34*a* & 34*b* are provided. Each of the first fuel admission circuits 32*a* & 32*b* comprises three fuel injection orifices 36*a*, 36*b*, and each second circuit 34*a* & 34*b* likewise comprises three fuel injection orifices 38*a*, 38*b*, such that the injection system 12 serves to define sixteen independent modes whereby the air/fuel mixture can be injected. In this figure, it can also be seen that the fuel injection orifices 36*a*, 36*b*, 38*a*, and 38*b* of the first and second fuel admission circuits are regularly distributed all around the longitudinal axis X—X of the injection system and that they occupy angular positions that are offset relative to one another so as to encourage air/fuel mixing.

In yet another embodiment (not shown in the figures), sixteen first and sixteen second fuel admission circuits may be provided, each of said circuits being provided with two fuel injection orifices. As a result, such fuel injection means can define 256 independent modes of injecting the air/fuel mixture.

In FIGS. 1 and 2, it can be seen that the injection system 12 of the invention further comprises at least one radial feed circuit 40 feeding fuel both to the first and to the second fuel admission circuits 32 and 34. This feed duct 40 advantageously comprises a plurality of tubes, e.g. concentric tubes, each feeding one of the fuel admission circuits. In the example shown in FIG. 2, the feed duct comprises two tubes 42 and 44. More precisely, a central first tube 42 of the duct feeds fuel to the second fuel admission circuit 34, which circuit is preferably toroidal in shape (FIG. 3). A second duct 44 concentric about the first feeds fuel to the first circuit 32. When a plurality of first and second fuel admission circuits are provided, as many concentric tubes are provided are there are circuits. Thus, fuel is fed to the fuel admission circuits via a single duct 40, thereby limiting the risks of fuel coking. Alternatively, it is possible to envisage having fuel feed ducts that are parallel and mutually independent.

The fuel present in the fuel admission circuits is protected from the hot gases coming from combustion of the air/fuel mixture by heat screens 46 which are interposed in particular between the circuits 32, 34 and the upstream and downstream walls 28 and 30 of the Venturi 26. The fuel which flows in the fuel admission circuits also serves to cool the walls of the Venturi. When a plurality of first and second fuel admission circuits are present, the heat screens may also serve to separate the various circuits from one another.

According to another advantageous characteristic of the invention, the injection system further comprises additional air or fuel injection means 48 (shown in dashed lines in FIG. 2) centered on the longitudinal axis X—X of the injection system. These additional injection means 48 thus serve to define additional modes in which the air/fuel mixture can be injected. By way of example, when additional fuel injection means are provided, fuel injected solely via said means can correspond to the engine operating at idling speed, and fuel injected simultaneously via said additional means and via the orifices of the first fuel admission circuits can be suitable for an entire range of intermediate feeds. Finally, injecting fuel via the additional means and via the orifices of the first and second circuits can coincide with the engine operating at full throttle.

The additional air or fuel injection means 48 are preferably mounted on a bowl 50 centered on the longitudinal axis X—X and extending downstream from the first air injection means. When additional fuel injection means are provided, they can be constituted, for example, by a conventional fuel injector passing through an end wall 52 of the bowl 50. Similarly, when additional air injection means are provided, they can be formed by a conventional air swirler, likewise passing through the end wall 52 of the bowl.

Finally, it may also be observed that a mixture tube 54 is disposed downstream from the outer swirler 24. This mixture tube has a wall 56 converging downstream and terminating in a substantially radial wall 58 which is extended inside the combustion chamber by a deflector 60. This tube serves to accelerate the flow of the air/fuel mixture towards the combustion chamber and serves to prevent the combustion flame from blowing back upstream.

What is claimed is:

1. An injection system for injecting an air/fuel mixture into a combustion chamber of a gas turbine engine, said injection system having a longitudinal axis and comprising fuel injection means interposed between first and second air injection means, said fuel injection means being disposed in an annular internal cavity of a Venturi, said cavity being defined by a substantially axial upstream wall and by a substantially radial downstream wall, said fuel injection means comprising at least a first fuel admission circuit provided with at least one fuel injection orifice, and a plurality of second fuel admission circuits independent from the first fuel admission circuit(s), each being provided with at least one fuel injection orifice so as to define a plurality of independent modes of injecting the air/fuel mixture depending on determined operating speeds of the engine, wherein the fuel injection orifice of the first fuel admission circuit is formed in the upstream wall of the Venturi so as to inject fuel towards the combustion chamber in a general direction that is substantially perpendicular to a flow of air coming from the first air injection means, and wherein the fuel injection orifices of the second fuel admission circuits are formed in the downstream wall of the Venturi so as to inject fuel towards the combustion chamber in a general direction that is substantially perpendicular to a flow of air coming from the second air injection means.

2. A system according to claim 1, wherein the fuel injection orifices of said first and second fuel admission circuits are distributed regularly all around said longitudinal axis.

3. A system according to claim 1, wherein the fuel injection orifice of said first fuel admission circuit has an angular position that is offset relative to the fuel injection orifices of said second fuel admission circuits.

4. A system according to claim 1, wherein the second fuel admission circuits are toroidal in shape.

5. A system according to claim 1, further comprising at least one radial feed duct feeding fuel to the first and second fuel admission circuits.

6. A system according to claim 5, wherein the feed duct comprises a plurality of concentric tubes each feeding a fuel admission circuit.

7. A system according to claim 1, further comprising additional air injection means centered on the longitudinal axis of the injection system.

8. A system according to claim 1, further comprising additional fuel injection means centered on the longitudinal axis of the injection system.

9. A system according to claim 7, wherein said additional injection means are mounted on a bowl centered on said longitudinal axis and extending downstream from the first air injection means.

10. A system according to claim 1, wherein the first and second air injection means are disposed radially relative to said longitudinal axis.

11. A system according to claim 1, wherein the first and second air injection means are constituted respectively by an inner swirler and by an outer swirler.

* * * * *